US009056707B2

(12) United States Patent
Ge et al.

(10) Patent No.: US 9,056,707 B2
(45) Date of Patent: Jun. 16, 2015

(54) PROTECTION CASE FOR ELECTRONIC DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Hai-Qian Ge, Shenzhen (CN); Che-Yu Chou, New Taipei (TW); Wen-Chih Lan, New Taipei (TW); Qun Huang, Shenzhen (CN); Tai-Shan Zhu, Shenzhen (CN); Tao Jiang, Shenzhen (CN); Jun-Liang Zhang, Shenzhen (CN); Wei-Wei Yu, Shenzhen (CN); Zhi-Jun Shi, Shenzhen (CN); Ji-Bing Guo, Shenzhen (CN); Hua-Yong Wang, Shenzhen (CN); Zhou Chen, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 13/779,774

(22) Filed: Feb. 28, 2013

(65) Prior Publication Data

US 2013/0220865 A1 Aug. 29, 2013

(30) Foreign Application Priority Data

Feb. 28, 2012 (CN) ..... 2012 1 0046620

(51) Int. Cl.

| | |
|---|---|
| ***A45F 4/00*** | (2006.01) |
| ***A45C 15/00*** | (2006.01) |
| ***B65H 75/40*** | (2006.01) |
| ***B65H 75/38*** | (2006.01) |
| ***B65H 23/06*** | (2006.01) |
| ***B65H 77/00*** | (2006.01) |
| ***B65H 59/16*** | (2006.01) |
| ***G03B 23/02*** | (2006.01) |
| ***G11B 23/04*** | (2006.01) |
| ***B65H 75/48*** | (2006.01) |
| ***A45C 13/26*** | (2006.01) |

(Continued)

(52) U.S. Cl.

CPC ..... *B65D 81/02* (2013.01); *A45C 11/00* (2013.01); *A45C 2011/001* (2013.01); *A45C 2011/002* (2013.01); *A45C 2011/003* (2013.01); *A45F 2005/006* (2013.01); *A45F 2005/1013* (2013.01); *A45F 2200/0508* (2013.01); *A45F 2200/0516* (2013.01)

(58) Field of Classification Search

USPC ..... 224/615, 578, 162, 258; 242/404.1, 242/422.3, 422.8, 345.2, 372; 150/108

See application file for complete search history.

(56) References Cited

U.S. PATENT DOCUMENTS 4,685,315 A * 8/1987 Comolli ..... 70/68
5,027,874 A * 7/1991 Gazzola ..... 150/108

(Continued)

*Primary Examiner* — Brian D Nash
*Assistant Examiner* — Derek Battisti
(74) *Attorney, Agent, or Firm* — Novak Druce Connolly Bove + Quigg LLP

(57) ABSTRACT

A protection case for receiving an electronic device. The protection case includes a receiving body for receiving the electronic device, a pair of winding mechanisms correspondingly set at two opposite sides of the receiving body, and a pair of belts correspondingly being wound on the winding mechanisms. The belts extend retractably out from the winding mechanisms to fasten the receiving body to a user.

17 Claims, 5 Drawing Sheets

(51) Int. Cl.

| | |
|---|---|
| ***A45C 13/30*** | (2006.01) |
| ***B65D 81/02*** | (2006.01) |
| ***A45C 11/00*** | (2006.01) |
| *A45F 5/00* | (2006.01) |
| *A45F 5/10* | (2006.01) |

(56) References Cited

U.S. PATENT DOCUMENTS

| | | | | |
|---|---|---|---|---|
| 5,294,029 | A * | 3/1994 | Shimura et al. | 224/162 |
| 5,294,167 | A * | 3/1994 | Yu | 242/372 |
| 5,352,006 | A * | 10/1994 | Ocuin | 294/142 |
| 5,722,518 | A * | 3/1998 | Aumasson | 190/115 |
| 5,762,169 | A * | 6/1998 | Deliman et al. | 190/101 |
| 5,881,932 | A * | 3/1999 | Wadden | 224/153 |
| 5,897,039 | A * | 4/1999 | Swenke | 224/162 |
| 6,250,578 | B1 * | 6/2001 | Manda | 242/378.1 |
| 7,458,488 | B2 * | 12/2008 | Bass et al. | 224/162 |
| 8,109,421 | B2 * | 2/2012 | McLean et al. | 224/270 |
| 2001/0015391 | A1 * | 8/2001 | Katoh | 242/372 |
| 2006/0037987 | A1 * | 2/2006 | Lin | 224/646 |

* cited by examiner

PROTECTION CASE FOR ELECTRONIC DEVICE

TECHNICAL FIELD

The disclosure generally relates to cases, and particularly to a protection case for an electronic device.

DESCRIPTION OF RELATED ART

A protection case for an electronic device is usually designed for protecting the electronic device from being damaged by a sudden impact, dust, or moisture, but these cases make holding the electronic device awkward. If a user is not careful when handling such a protected electronic device, the electronic device may fall and be damaged or destroyed.

Therefore, it is desirable to provide a means which can overcome the above-mentioned problems.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding portions throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one".

Figure 1:
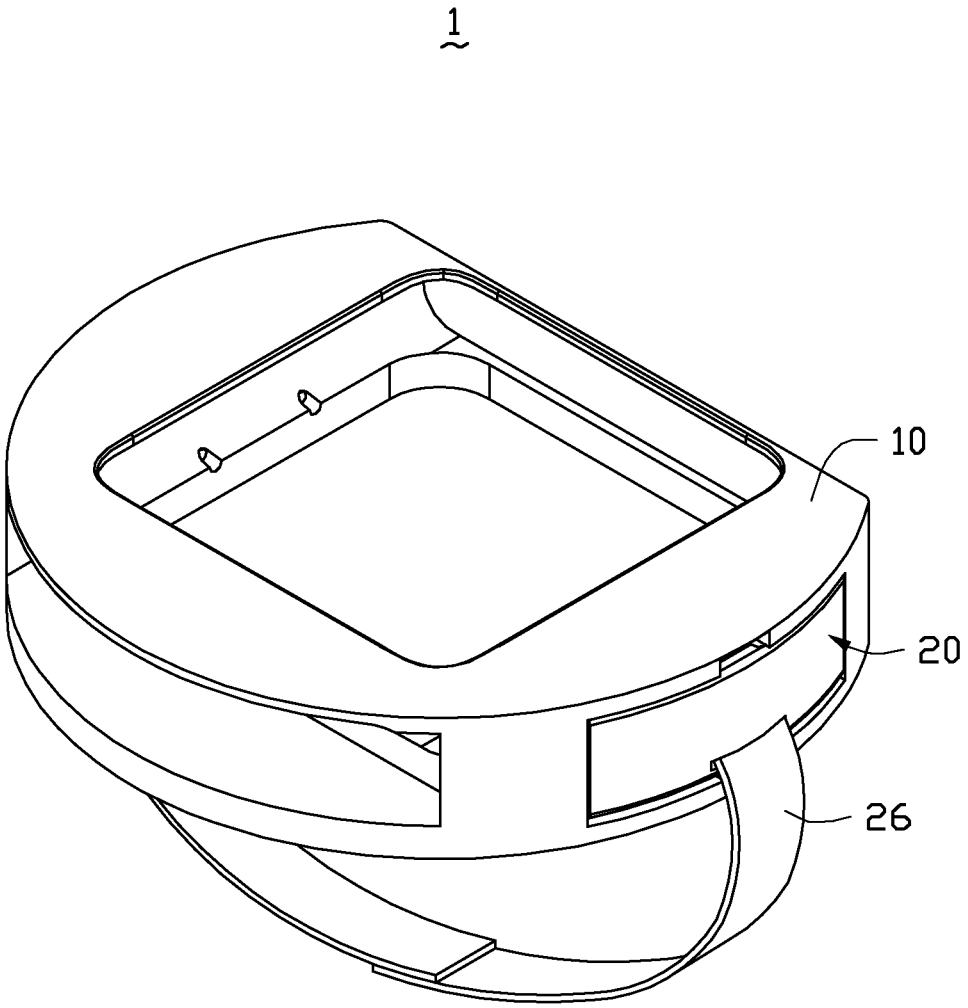
FIG. 1 is an isometric view of a protection case in accordance with an exemplary embodiment of the present disclosure, the protection case including a receiving body, a pair of winding mechanisms, and a pair of belts.
Figure 2:
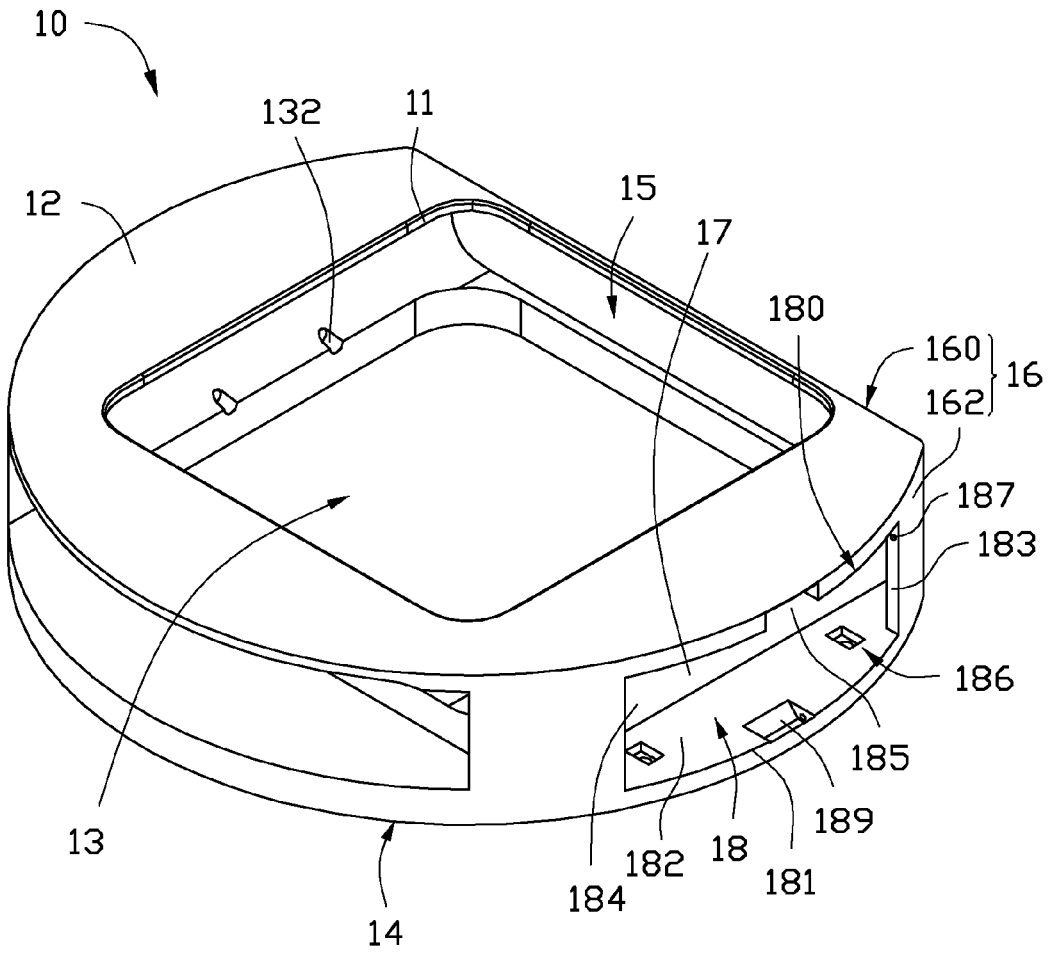
FIG. 2 is an isometric view of the receiving body of FIG. 1.

FIGS. 1 and 2 illustrate a protection case 1 in accordance with an exemplary embodiment. The protection case 1 includes a receiving body 10, a pair of winding mechanisms 20, and a pair of belts 26 being correspondingly wound on the winding mechanisms 20. The receiving body 10 includes a receiving cavity 13 and a pair of receiving grooves 18. The receiving cavity 13 is used for accommodating an electronic device (not shown), and the pair of receiving grooves 18 is used for accommodating the pair of winding mechanisms 20. The belts 26 extend retractably out from the winding mechanisms 20 and the receiving grooves 18 to hang the receiving body 10 on an object such as a wrist, an arm or a shoulder of a user to carry the receiving body 10.

FIG. 2 further illustrates that the receiving body 10 includes a top board 12, a bottom board 14 parallel to the top board 12, an inner wall 17, and a side wall 16 perpendicularly connected to the top board 12 and the bottom board 14. The top board 12, the bottom board 14, a portion of the side wall 16, and the inner wall 17 cooperatively define the receiving cavity 13. The top board 12, the bottom board 14, the other portion of the side wall 16 and the inner wall cooperatively define the pair of receiving grooves 18.

The side wall 16 includes a flat first part 160 and a curved second part 162. The first part 160 defines a first opening 15 and the top board 12 defines a second opening 11. Both of the first opening 15 and the second opening 11 communicate with the receiving cavity 13 so as to expose portions of the electronic device. For example, the first opening 15 is configured to expose a number of buttons of the electronic device. The second opening 11 is configured to expose a display surface of the electronic device. The pair of receiving grooves 18 are defined to be adjacent to two opposite sides of the second part 162, the two opposite sides of the second part 162 are adjacent to two opposite ends of the first part 160. Each of the receiving grooves 18 includes an upper surface 180, a lower surface 182, and a bottom surface 184. The upper surface 180 may be a portion of an inner surface of the top board 12, the lower surface 182 may be a portion of an inner surface of the bottom board 14, and the bottom surface 184 may be a surface of the inner wall 17. A third opening 186 is defined in the second part 162 and acts as an opening of the receiving groove 18. The bottom surface 184 faces the third opening 186. A first rotating hole 188 (see FIG. 4) is defined in the bottom surface 184 and close to the upper surface 180; and a number of positioning through holes 132 extending from the bottom surface 184 and passing through the inner wall 17 so as to communicate the receiving groove 18 with the receiving cavity 13.

A pair of first peripheries 181 are formed between the third opening 186 and a top surface of the top board 12 or a bottom surface of the bottom board 14. A pair of second peripheries 183 are formed in the second part 162 and perpendicularly connected to the first peripheries 181. A first cutout 185 is defined in an upper first periphery 181 and communicates with the receiving groove 18. A fastening recess 187 is defined in a side of each second periphery 183 which is close to the top board 12.

The bottom board 14 defines a rotating groove 189 adjacent to a middle of a lower first periphery 181.

Figure 3:
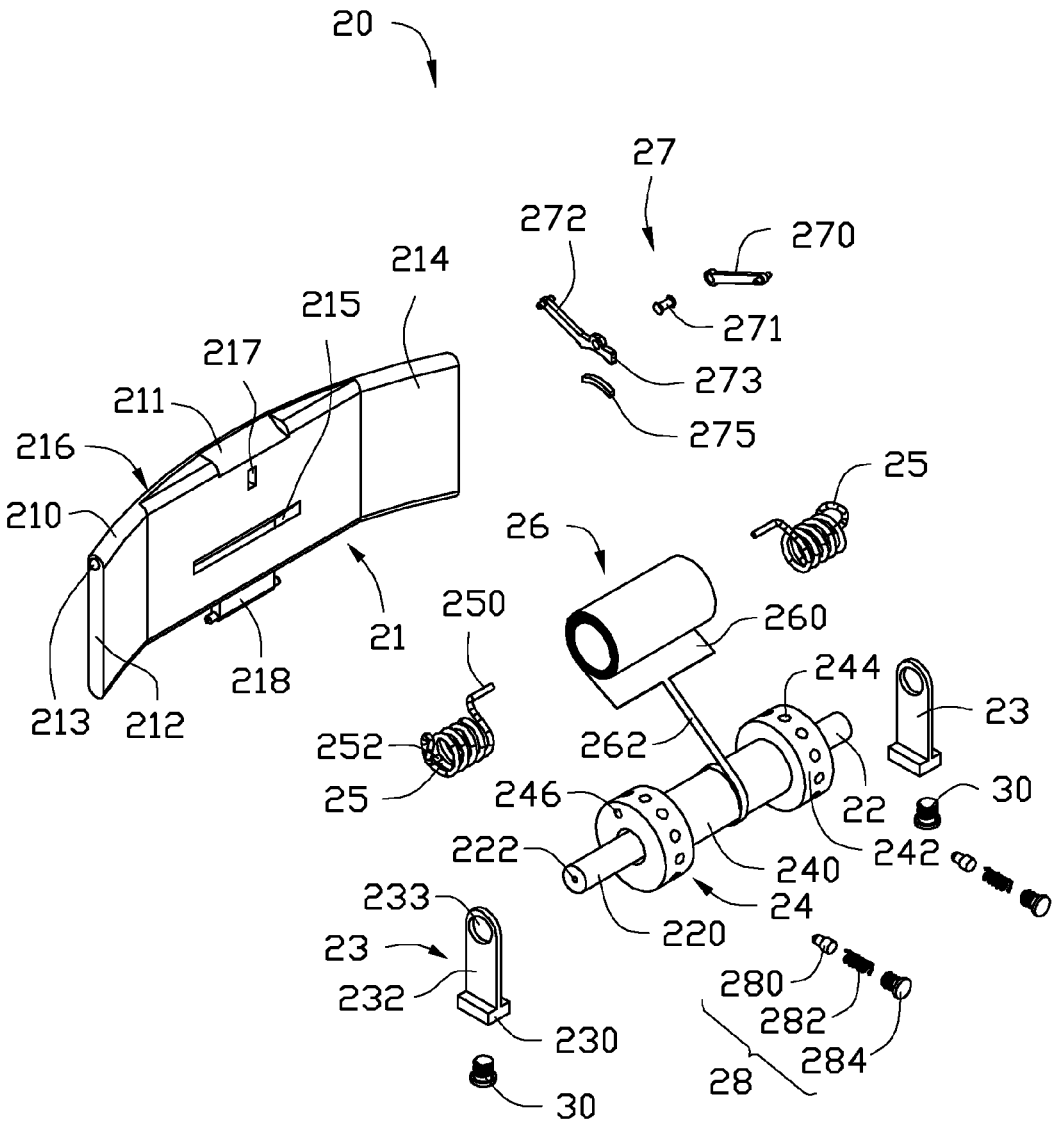
FIG. 3 is an exploded, isometric view of the winding mechanism of FIG. 1.

FIG. 3 illustrates that each of the winding mechanisms 20 includes a pair of covers 21, a holding rod 22, a pair of supporting posts 23, a winder 24, a pair of resilient pieces 25, a stretchable arm 27, and a pair of positioning assemblies 28.

Each of the covers 21 is substantially a rectangular board which is similar to the third opening 186 in size. The cover 21 is slightly bent along a longitudinal direction thereof. The cover 21 includes a pair of parallel third peripheries 210, a pair of fourth peripheries 212 perpendicularly connected to the third peripheries 210, an inner side surface 214, an outer side surface 216, a rotating projection 218 extending from a middle of the lower third periphery 210, and a pair of fastening protrusions 213 correspondingly extending from a place on each of the fourth peripheries 212 close to the upper third periphery 210. The cover 21 defines a second cutout 211 at a middle of the upper third periphery 210. The cover 21 defines a belt exit 215 at a place on the inner side surface 214 close to the rotating projection 218. The cover 21 defines a second rotating hole 217 at a place on the inner side surface 214 close to the second cutout 211.

The holding rod 22 is substantially an elongated cylindrical rod and correspondingly defines a first fastening hole 222 in each of two opposite end surfaces 220 along a longitudinal direction of the holding rod 22.

Each of the supporting posts 23 includes a base 230 and a supporting plate 232 extending perpendicularly from the base 230. The supporting post 23 defines an assembly hole 233 in an end of the supporting plate 232 away from the base 230.

The winder 24 is substantially a hollow cylindrical sleeve and includes a pair of positioning sections 242 and a holding section 240 located between the pair of positioning sections 242. The radius of the positioning section 242 is greater than the radius of the holding section 240. The winder 24 defines a number of evenly spaced positioning recesses 244 in a circumferential surface of each positioning section 242 along an axial direction of the winder 24. The winder 24 defines a second fastening hole 246 in an outer end surface of each positioning section 242 away from the holding section 240.

The resilient pieces are configured to connect the winder 24 with the holding posts 22. Each of the resilient pieces 25 includes a first end 250 and a second end 252. In this embodiment, each of the resilient pieces 25 is a torsion spring.

The belt 26 includes a wide section 260 and a narrow section 262. A width of the wide section 260 is greater than a width of the narrow section 262. The narrow section 262 is connected to a middle of an end of the wide section 260. The narrow section 262 and the wide section 260 are orderly wrapped on the holding section 240. Each of the pair of belts 26 is wrapped on the holding section 240 with the narrow section 262 first wrapped on the holding section 240.

The stretchable arm 27 includes a first connecting rod 270 and a second connecting rod 272. The first connecting rod 270 is pivotally connected to the second connecting rod 272 via a pivot 271. The second connecting rod 272 includes a brake 273 formed at an end of the second connecting rod 272 in which the first connecting rod 270 is connected. A braking block 275 is assembled on the brake 273.

Each of the positioning assemblies 28 includes a positioning block 280, a spring 282, and a fastening bolt 284. The positioning block 280 and the fastening bolt 284 are correspondingly connected to two opposite ends of the spring 282. The positioning assembly is configured to engages with the positioning recesses 244 on the positioning section 242 to position the rotating angle of the winder 24.

Figure 4:
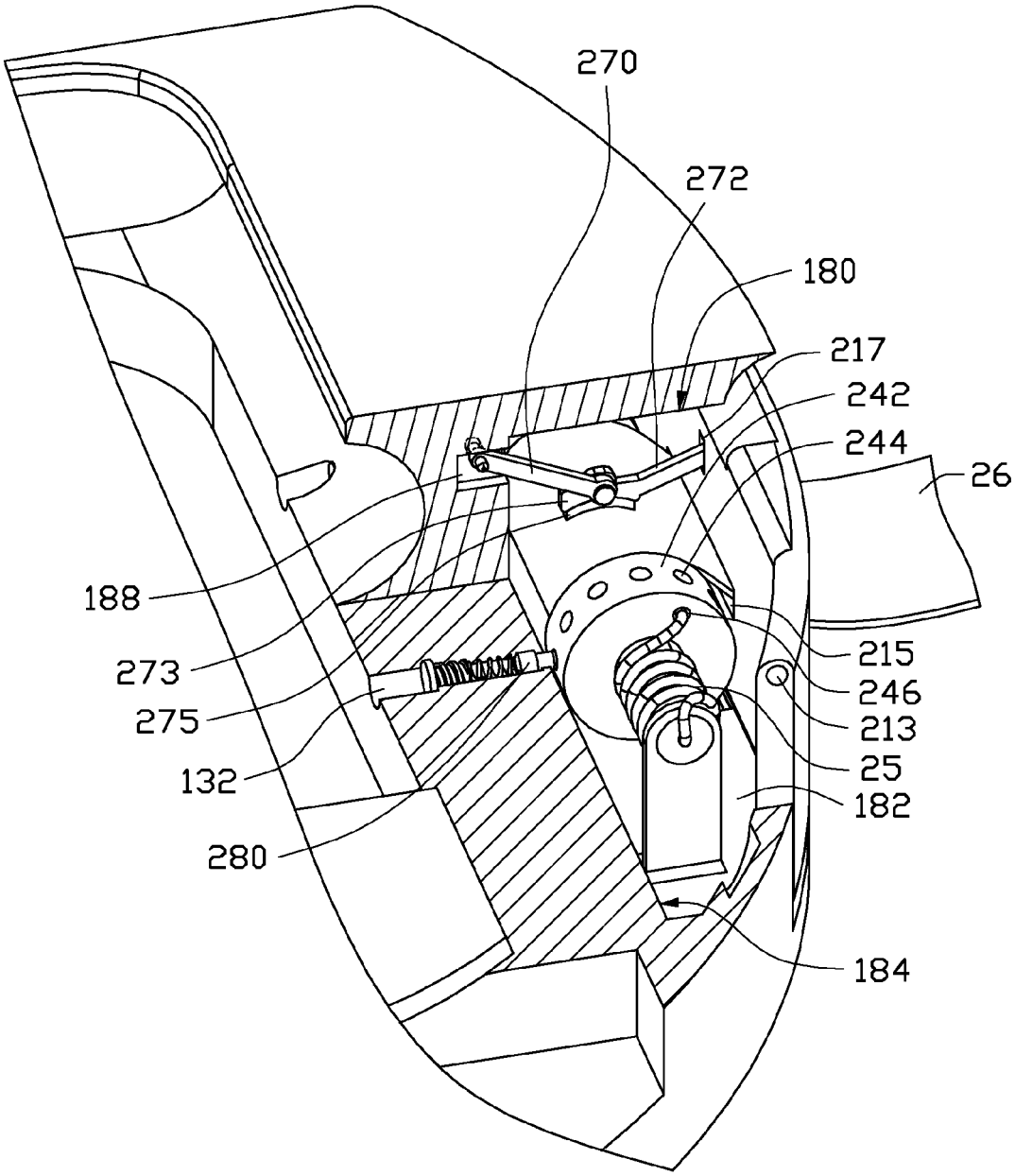
FIG. 4 is a cutaway view of the assembled protection case of FIG. 1.

FIGS. 2, 3, and 4 illustrate that in assembly, the winder 24 is sleeved on a middle of the holding rod 22. The resilient pieces 25 are correspondingly sleeved on the holding rod 22 from two opposite ends of the holding rod 22 along a longitudinal direction of the holding rod 22. Thus, the winder 24 is located between the pair of resilient pieces 25. Two opposite ends of the holding rod 22 are correspondingly fastened to the assembly hole 233 on the supporting plate 232. The first end 250 of the resilient piece 25 is connected to the second fastening hole 246. The second end 252 of the resilient piece 25 is connected to the first fastening hole 222. The base 230 are fastened to the lower surface 182 via a bolt 30.

An end of the first connecting rod 270 opposite to the second connecting rod 272 is pivotally connected to the first rotating hole 188. An end of the second connecting rod 272 opposite to the first connecting rod 270 is pivotally connected to the second rotating hole 217.

The positioning assemblies 28 are correspondingly received in the positioning through holes 132. An opening of each positioning through hole 132 on the inner side surface 184 is aligned with the positioning section 242. The positioning blocks 280 retractably extend out of the positioning through hole 132 via the opening on the inner side surface 184 and inserted into the positioning recesses 244 on the positioning section 242 to position the winder 24.

The cover 21 is pivotally connected to the rotating groove 189 via the rotating projection 218. When the cover 21 is closed, the fastening protrusions 213 insert into the fastening recesses 187 to fasten the cover to the receiving body 10, the second cutout 211 is aligned with the first cutout 185, the brake 273 is driven to press on the winder 24 to fasten the belts 26.

When the cover 21 needs to be opened, the cover 21 is rotated outwards via a gap between the first cutout 185 and the second cutout 211. The fastening protrusions 213 are released from the fastening recesses 187. The brake 237 is moved away from the winder 24 to loosen the belts 26.

In use, to open the cover 21 for loosening the belts 26, the free end of the belts 26 extend out from the belt exit 215. When the belts 26 are pulled out from the winder 24, the winder 24 is driven to rotate in a first direction by the belts 26. The positioning blocks 280 are released from the positioning recesses 244 when the winder 24 is driven to rotate. The resilient pieces 25 are twisted when the winder 24 rotates in the first direction, and accumulates potential energy.

When the belts 26 are pulled out to a desired length and the external force on the belts 26 is relaxed or released, the positioning blocks 280 may or may not be aligned with the positioning recesses 244. If the positioning blocks 280 are not aligned with the positioning recesses 244, the winder 24 automatically changes a slight angle due to restoring force applied by the resilient pieces 25, and as a result the positioning blocks 280 align with the positioning recesses 244. If and when the positioning blocks 280 are aligned with the positioning recesses 244, the positioning blocks 280 are inserted into the positioning recesses 244 again due to restoring forces applied by the springs 282. Thereby, back rotation of the winder 24 is prevented, and the belts 26 stay in position extended out a desired length from the receiving body 10.

When the belts 26 need to be wrapped back on the winder 24, the belts 26 are further pulled out of the receiving body 10 a little to slightly rotate the winder 24, and therefore cause the positioning blocks 280 to be released from the positioning recesses 244. Thus, the winder 24 is driven to rotate in a second direction by the restoring force of the twisted resilient pieces 25. The second direction is contrary to the first direction. The belts 26 are wrapped back on the winder 24 when the winder 24 is driven to rotate in the second direction. During the rotation in the second direction, the winder 24 rotates too quickly to allow the positioning blocks 280 to insert into the positioning recesses 244, thus the rotation in the second direction does not stop. Once the belts 26 have been retracted to a desired length, the belts 26 are held and then the winder 24 is driven to be slightly rotated in either clockwise or anticlockwise direction to make the positioning blocks 280 insert into the positioning recesses 244 again. Thereby, the backwards rotation of the winder 24 is prevented.

Figure 5:
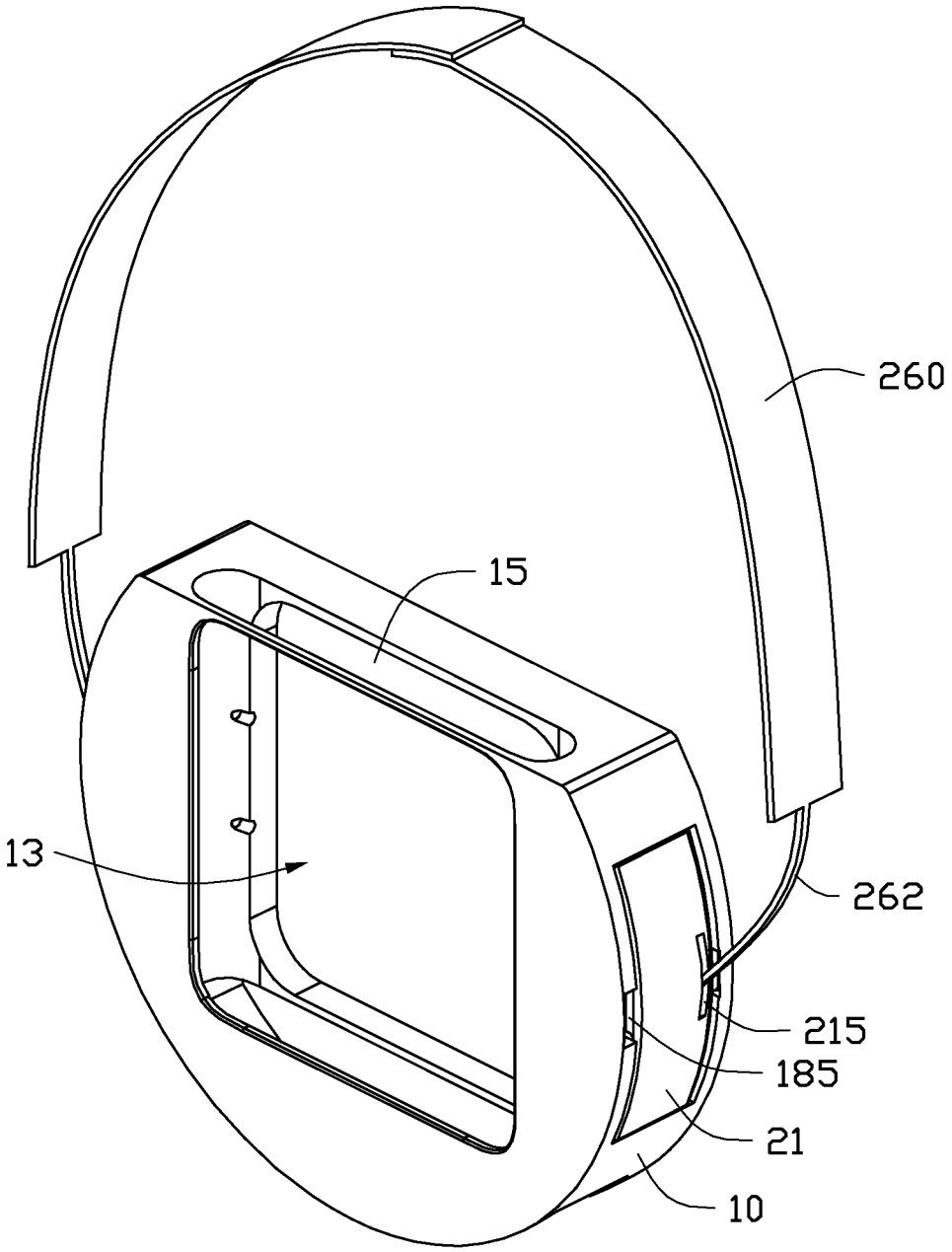
FIG. 5 is an isometric view of a protection case of FIG. 1, showing the other use state of the protection case.

It is understood that, the protection case can be fasten in different forms according to the length of the belts 26 extending out of the receiving body 10. For example, FIG. 1 illustrates that when the exposed belt 26 is short, the protection case 1 can be fastened to the wrist by the free ends of the belts 26 adhereing to each other. FIG. 5 illustrates when the exposed belts 26 are long and the narrow section 262 has been pulled out of the receiving body 10, the belts 26 can be laid on the shoulder to carry the protection case 1.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A protection case for receiving an electronic device, the protection case comprising:

a receiving body for receiving the electronic device;

a pair of winding mechanisms correspondingly set at two opposite sides of the receiving body; and a pair of belts correspondingly being wound on the winding mechanisms, wherein each of the pair of belts comprises a wide section and a narrow section, a width of the wide section is greater than a width of the narrow section, the narrow section is connected to a middle of an end of the wide section, and each of the pair of belts is wrapped on the winding mechanism with the narrow section first wrapped on the winding mechanism;

wherein the belts extend from the winding mechanisms to fasten the receiving body to a user, the receiving body comprises a top board, a bottom board parallel to the top board, an inner wall, and a side wall perpendicularly connected to the top board and the bottom board, the top board, the bottom board, a portion of the side wall, and the inner wall cooperately define the receiving body, the receiving body comprises a pair of receiving grooves adjacent to two opposite sides of the side wall, and a receiving cavity located between the pair of receiving grooves, the winding mechanisms are correspondingly accommodated in the receiving grooves, each of the winding mechanisms comprises a pair of supporting posts fastened to a lower surface of the receiving groove, a holding rod, a winder, and a pair of resilient pieces, two opposite ends of the holding rod are correspondingly connected to the top ends of the supporting posts, the winder is rotatably sleeved on the holding rod, and the resilient pieces connect two ends of the winder with two corresponding ends of the holding post to provide a restoring force to the winder, the belt is wound on the winder.

2. The protection case of claim 1, wherein the winder comprises a pair of positioning sections and a holding section located between the pair of positioning sections, the winder defines a plurality of evenly spaced positioning recesses in a circumferential surface of each positioning section along an axial direction of the winder.

3. The protection case of claim 2, wherein the radius of the positioning section is greater than the radius of the holding section.

4. The protection case of claim 2, wherein the winder defines a second fastening hole in an outer end surface of each positioning section away from the holding section, the holding rod defines a first fastening hole in each of two opposite end surfaces along a longitudinal direction of the holding rod, the resilient pieces are correspondingly sleeved on the holding rod from two opposite ends of the holding rod, the winder is located between the pair of resilient pieces, two opposite ends of each resilient pieces is correspondingly connected to the first fastening hole and the second fastening hole.

5. The protection case of claim 2, wherein each of the winding mechanisms further comprises a pair of positioning assemblies correspondingly received in a pair of positioning through holes extending through the inner wall and communicating the receiving cavity and the receiving groove, the pair of positioning assemblies correspondingly engage with the positioning recesses to position the rotation of the winder.

6. The protection case of claim 5, wherein each of the positioning assemblies comprises a spring, a positioning block, a fastening bolt, the positioning block and the fastening bolt are correspondingly connected to two opposite ends of the spring, an opening of each positioning through hole defined on an inner side surface of the receiving groove is aligned with the positioning section, the positioning blocks extend retractably out of the positioning through hole via the opening and insert into the positioning recesses to position the winder.

7. The protection case of claim 1, wherein each of the winding mechanism further comprises a pair of covers for correspondingly covering a pair of openings of the pair of receiving grooves, a pair of first peripheries are formed between the opening and a top surface of the top board or a bottom surface of the bottom board, a pair of second peripheries are formed in the second part and perpendicularly connected to the first peripheries, each of the covers comprises a pair of parallel third peripheries, a pair of fourth peripheries perpendicularly connected to the third peripheries, an inner side surface, and a outer side surface, the cover is pivotally connected to the lower first periphery via a rotating projection extending out from the lower third periphery.

8. The protection case of claim 7, wherein a fastening recess is defined in a side of each second periphery which is close to the top board, each of the covers comprises a pair of positioning protrusions correspondingly extending out from a place on each of the fourth peripheries close to the upper third periphery, the fastening protrusions correspondingly inserted into the fastening recesses when the covers are closed to the opening of the receiving grooves to fasten the covers to the receiving body.

9. The protection case of claim 7, wherein a first cutout is defined in the upper first periphery and communicates with the receiving groove, each of the covers defines a second cutout at a middle of the upper third periphery, the second cutout is aligned with the first cutout when the cover is closed to the opening of the receiving grooves.

10. The protection case of claim 8, wherein the winding mechanism further comprises a stretchable arm, the stretchable arm comprises a first connecting rod and a second connecting rod pivotally connected to the second connecting rod via a pivot, an end of the first connecting rod opposite to the second connecting rod is pivotally connected to the inner wall, an end of the second connecting rod opposite to the first connecting rod is pivotally connected to inner side surface of the cover.

11. The protection case of claim 10, wherein the second connecting rod comprises a brake formed at an end of the second connecting rod to which the first connecting rod is connected, a braking block is assembled on the brake, when the cover is closed to the opening of the receiving body, the brake is driven to press on the winder to fasten the belts.

12. The protection case of claim 7, wherein the cover defines a belt exit at a place on the inner side surface close to the lower third periphery, the belts are extended out of the receiving body via the belt exit.

13. A protection case for receiving an electronic device, the protection case comprising:

a receiving body for receiving the electronic device;

a pair of winding mechanisms correspondingly set at two opposite sides of the receiving body; and a pair of belts correspondingly being wound on the winding mechanisms;

wherein the belts extend from the winding mechanisms to fasten the receiving body to a user, the receiving body comprises a top board, a bottom board parallel to the top board, an inner wall, and a side wall perpendicularly connected to the top board and the bottom board, the top board, the bottom board, a portion of the side wall, and the inner wall cooperately define the receiving body, the receiving body comprises a pair of receiving grooves adjacent to two opposite sides of the side wall, and a receiving cavity located between the pair of receiving grooves, the winding mechanisms are correspondingly accommodated in the receiving grooves, each of the winding mechanisms comprises a pair of supporting posts fastened to a lower surface of the receiving groove, a holding rod, a winder, and a pair of resilient pieces, two opposite ends of the holding rod are correspondingly connected to the top ends of the supporting posts, the winder is rotatably sleeved on the holding rod, the resilient pieces connect two ends of the winder with two corresponding ends of the holding post to provide a restoring force to the winder, the belt is wound on the winder, the winder comprises a pair of positioning sections and a holding section located between the pair of positioning sections, the winder defines a plurality of evenly spaced positioning recesses in a circumferential surface of each positioning section along an axial direction of the winder, each of the winding mechanisms further comprises a pair of positioning assemblies correspondingly received in a pair of positioning through holes extending through the inner wall and communicating the receiving cavity and the receiving groove, the pair of positioning assemblies correspondingly engage with the positioning recesses to position the rotation of the winder.

14. The protection case of claim 13, wherein each of the positioning assemblies comprises a spring, a positioning block, a fastening bolt, the positioning block and the fastening bolt are correspondingly connected to two opposite ends of the spring, an opening of each positioning through hole defined on an inner side surface of the receiving groove is aligned with the positioning section, the positioning blocks extend retractably out of the positioning through hole via the opening and insert into the positioning recesses to position the winder.

15. The protection case of claim 13, wherein the winder defines a second fastening hole in an outer end surface of each positioning section away from the holding section, the holding rod defines a first fastening hole in each of two opposite end surfaces along a longitudinal direction of the holding rod, the resilient pieces are correspondingly sleeved on the holding rod from two opposite ends of the holding rod, the winder is located between the pair of resilient pieces, two opposite ends of each resilient pieces is correspondingly connected to the first fastening hole and the second fastening hole.

16. The protection case of claim 13, wherein each of the winding mechanism further comprises a pair of covers for correspondingly covering a pair of openings of the pair of receiving grooves, a pair of first peripheries are formed between the opening and a top surface of the top board or a bottom surface of the bottom board, a pair of second peripheries are formed in the second part and perpendicularly connected to the first peripheries, each of the covers comprises a pair of parallel third peripheries, a pair of fourth peripheries perpendicularly connected to the third peripheries, an inner side surface, and a outer side surface, the cover is pivotally connected to the lower first periphery via a rotating projection extending out from the lower third periphery.

17. The protection case of claim 13, wherein each of the pair of belts comprises a wide section and a narrow section, a width of the wide section is greater than a width of the narrow section, the narrow section is connected to a middle of an end of the wide section, and each of the pair of belts is wrapped on the winding mechanism with the narrow section first wrapped on the winding mechanism.

* * * * *